United States Patent [19]

Gendron

[11] 4,012,917

[45] Mar. 22, 1977

[54] BRIDGE BEAM TOWER ERECTION METHODS AND APPARATUS

[75] Inventor: George J. Gendron, Houston, Tex.

[73] Assignee: Raymond International Inc., Houston, Tex.

[22] Filed: Oct. 6, 1975

[21] Appl. No.: 620,253

[52] U.S. Cl. ..... 61/91; 61/96; 61/50

[51] Int. Cl.[2] ..... B63B 35/44

[58] Field of Search ..... 61/46.5, 46, 50, 52

[56] References Cited

UNITED STATES PATENTS

| | | | |
|---|---|---|---|
| 2,430,014 | 11/1947 | Hansen | 61/46.5 |
| 2,857,744 | 10/1958 | Swiger et al. | 61/46.5 |
| 2,948,119 | 8/1960 | Suderow | 61/46.5 |
| 3,007,316 | 11/1961 | Higgins | 61/46.5 |
| 3,857,247 | 12/1974 | Phares | 61/46.5 |
| 3,874,180 | 4/1975 | Sumner | 61/46.5 |
| 3,876,181 | 4/1975 | Lucas | 61/465 X |

*Primary Examiner*—Jacob Shapiro
*Attorney, Agent, or Firm*—Fitzpatrick, Cella, Harper & Scinto

[57] ABSTRACT

A platform is raised from water level up to the tops of prepositioned template legs by means of jacking units comprising jacking mechanisms and jacking legs mounted near the upper ends of the template legs. Bridge beams of open framework construction span the distances between the upper ends of the template legs and these bridge beams provide support for the jacking units as well as reinforcement for the platform when it has been raised.

27 Claims, 14 Drawing Figures

BRIDGE BEAM TOWER ERECTION METHODS AND APPARATUS

CROSS REFERENCE TO RELATED APPLICATION

This application discloses subject matter disclosed in copending United States application Ser. No. 620,203, filed Oct. 6, 1975 in the names of Lindsey J. Phares and George J. Gendron and entitled Method and Apparatus for Rapid Erection of Offshore Tower.

BACKGROUND OF THE INVENTION

1. Field of the Invention

This invention relates to the erection of structures and more particularly it concerns novel techniques for the construction of offshore towers and platforms such as are used in exploration and recovery of resources such as oil from beneath the sea bed.

2. Description of the Prior Art

Offshore towers and platforms of the type to which the present invention pertains are shown in U.S. Pat. No. 3,857,247 to Lindsey J. Phares and in U.S. Pat. No. 3,876,181 to Joseph E. Lucas. In both these patents there is described a two component system comprising a template or tower and a platform or deck, which are separately floated or carried by barge out to a desired offshore location. When the template arrives on location it is affixed in upright or vertical position to the sea bed with its legs extending up well beyond the water surface. The deck or platform is then positioned between the tower legs and is jacked up along the legs so that it is clear of the water surface and of all wave action. The platform is then pinned to the template and drilling and production operations are then carried out from the stably mounted, elevated platform.

Both the Phares and Lucas patents show arrangements for mounting jacking tubes to be suspended from the upper ends of the template legs so they extend down alongside the legs to the platform. Jacking mechanisms are provided on the platform to grip the jacking legs and pull the platform up via the jacking legs to the top of the template legs. After the elevated platform is secured to the template the jacks and jacking legs may be removed for use in the erection of another offshore tower.

SUMMARY OF THE INVENTION

The present invention provides improvements to the above described offshore tower erection techniques. More specifically, the present invention permits a more efficient and lower cost platform structure that has heretofore been necessary. That is, the platform structure may be of lighter weight and less rigid construction than previous platforms. In addition, with the present invention, a platform, once positioned adjacent the template, is made ready for a jacking up operation in a much shorter time than has heretofore been necessary. This is important because during the time the platform is riding on the water adjacent the template legs it is subject to the action of the sea and is vulnerable to damage should the sea conditions become severe.

According to one aspect of the present invention there is provided a novel method for erecting an offshore tower platform in which a template, having a plurality of vertical template legs, is positioned on the sea floor so that the template legs extend up above the sea level. The template is provided with at least one open framework bridge beam connected to and extending between the upper ends of the vertical template legs. A platform is floated out to the thus positioned template and is jacked up along the template legs, clear of the water, to the bridge beam. The platform is then connected to the bridge beam along its length so that it becomes stiffened and reinforced by the bridge beam. The platform thus may be made initially of lighter and less rigid construction than would be required if it had to span the distances between the template legs on its own.

According to another aspect of the invention a platform may be lifted along rigid jacking legs which extend from the open framework beam to the platform. This arrangement permits the positioning of the jacking legs at locations where they may most efficiently act upon the platform.

In another of its aspects the present invention provides rapid interconnection of a jacking unit between a platform and a template onto which the platform is to be lifted. According to this aspect a jacking mechanism is mounted on either the template or on the platform and is operative to move an elongated rigid jacking leg toward the other member until it passes through a slip in that other member. The slip is constructed to allow free movement of the jacking leg in a direction from the slip away from the first member but is operative to grip the jacking leg to prevent relative movement between the jacking leg and the other member in the opposite direction. The jacking mechanism is then operated to move the jacking leg in the opposite direction to elevate the platform clear of the water.

There has thus been outlined rather broadly the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures or methods for carrying out the several purposes of the invention. It is important, therefore, that the claims be regarded as including such equivalent constructions and methods as do not depart from the spirit and scope of the invention.

BRIEF DESCRIPTION OF THE DRAWINGS

Certain specific embodiments of the invention have been chosen for purposes of illustration and description, and are shown in the accompanying drawings, forming a part of the specification wherein:

FIG. 9 is a view similar to FIG. 7 but showing the platform in fully raised condition;

DETAILED DESCRIPTION OF THE PREFERRED EMBODIMENTS

Figure 1:
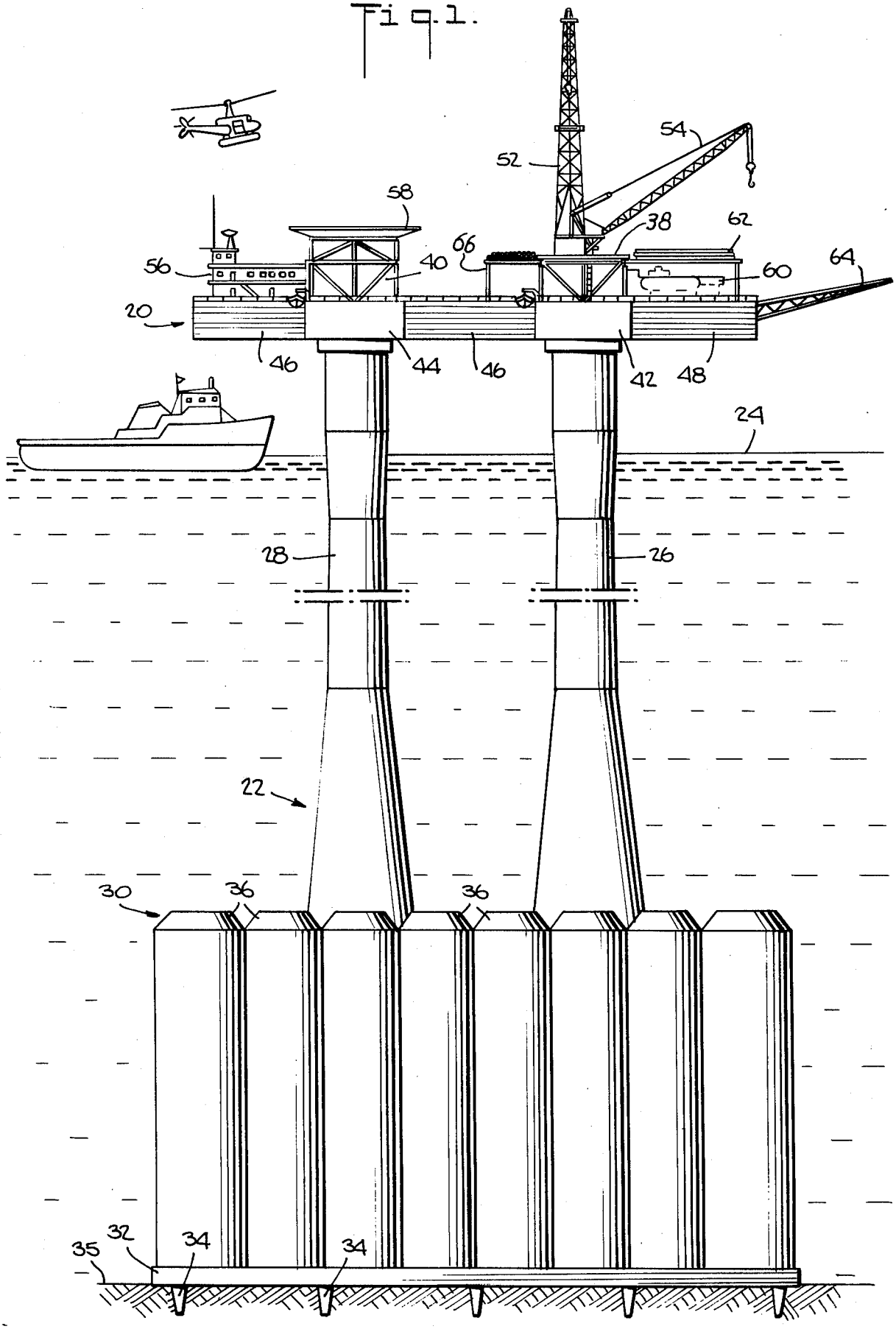
FIG. 1 is an elevational view of an offshore tower structure in which the present invention is embodied.

The offshore tower structure of FIG. 1 comprises a platform 20 which is held, by means of a template 22, in stationary position up above a sea surface 24 so as to be free of waves and sea currents.

The template 22 comprises forward and rearward pairs of vertical template legs 26 and 28 which extend up from a base 30. The base 30, in turn, comprises a base plate 32 which is pinned, as by anchor piles 34, to a sea bed 35, and a cluster of tubular elements 36 which extend upwardly from the plate 32 to surround the lower portion of the vertical legs 26 and 28.

Forward and rearward bridge beams 38 and 40, of trusslike open framework construction, extend across and span the distance between the upper ends of the forward and rearward legs respectively. These bridge beams are secured to pedestals 42 and 44 on top of the legs 26 and 28.

Figure 2:
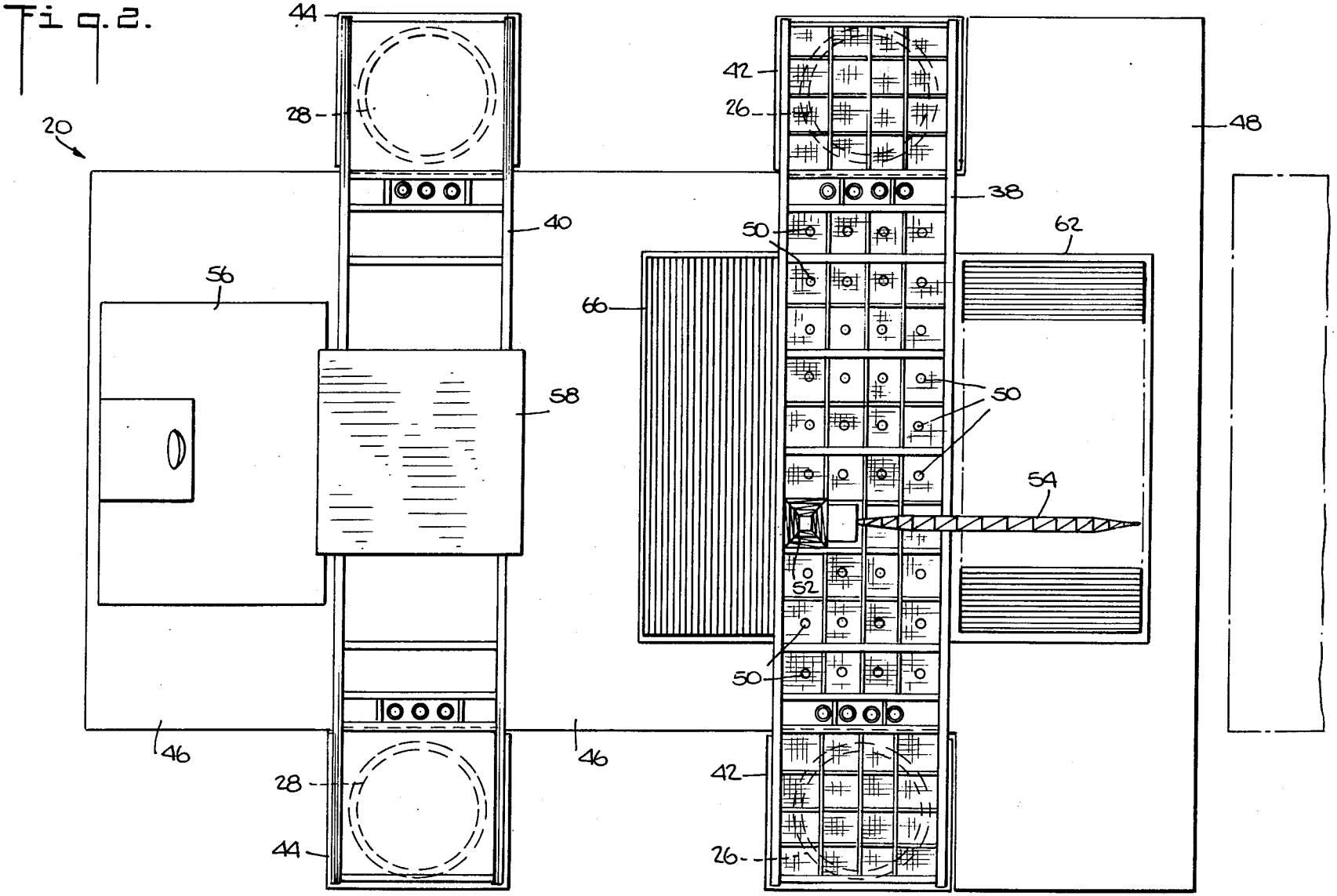
FIG. 2 is a top plan view of the offshore tower structure of FIG. 1.

As shown in FIGS. 1 and 2, the platform 20 is of expansive, generally flat configuration; and in plan view it is shaped as a T, with a base portion 46 and a cross portion 48. The base portion 46 of the T shaped platform extends lengthwise between and beyond the forward and rearward pairs of legs 26 and 28 and in its widthwise direction it extends the full distance between the corresponding legs of each pair. The cross portion 48 of the T shaped platform extends out forwardly and laterally beyond the forward legs 26.

The platform 20 is secured to the bridge beams 38 and 40 along their length; and consequently it is stiffened and strengthened by them. Because of this, the platform, although expansive in size, may be made of lighter construction than would have been necessary if the platform had to bridge the entire distance between the template legs without external bracing.

The offshore tower structure shown in FIGS. 1 and 2 is arranged for oil well drilling. As can be seen in FIG. 2, the forward bridge beam 38 is formed to define a grid like array of drilling locations 50 and to support a drilling tower 52 above different ones of those locations for exploratory drilling. The forward bridge beam 38 also supports a tower crane 54 which is used to position additional lengths of drill pipe in the tower 52.

Although the basic operative elements, i.e. the drilling tower 52 and the tower crane 54, are supported on the bridge beam 38, the platform 20 is required to support personnel, auxiliary equipment and supplies. Thus, as can be seen in FIGS. 1 and 2, there is provided a crew quarters 56 at the outer end of the platform base portion 46, and a helicoptor landing plaform 58 atop the rearward bridge beam 40. Power generating and control equipment 60 is arranged on the platform cross portion 48 and a drill pipe storage ledge 62 is constructed thereabove. A supply hoist 64 is also mounted along the forward edge of the platform cross portion 48 for bringing supplies and equipment up from ship or barges moored to the template. A tower and crane positioning ledge 66 is constructed on the platform 20 just behind the forward bridge beam 38. This ledge accomodates the drilling tower 52 and the tower crane 54 when the platform 20 is being moved into position on the template or when it is being dismantled from the template.

FIGS. 3–9 illustrate the manner of erecting the above described offshore tower at a desired location in the sea. As can be seen in the phantom outline portion of FIG. 3 the template 22 is towed, while floating, to a desired location; and it is then sunk to the sea bed 35 when it has arrived at this location. The flotation control of the template 22 can be carried out by external means (not shown) attached to it, or the template legs 26 and 28, and the tubular elements 36 may be hollow and selectively floodable. After the template has been sunk to the sea bottom, it is secured there by installation of the anchor piles 34.

Figure 3:
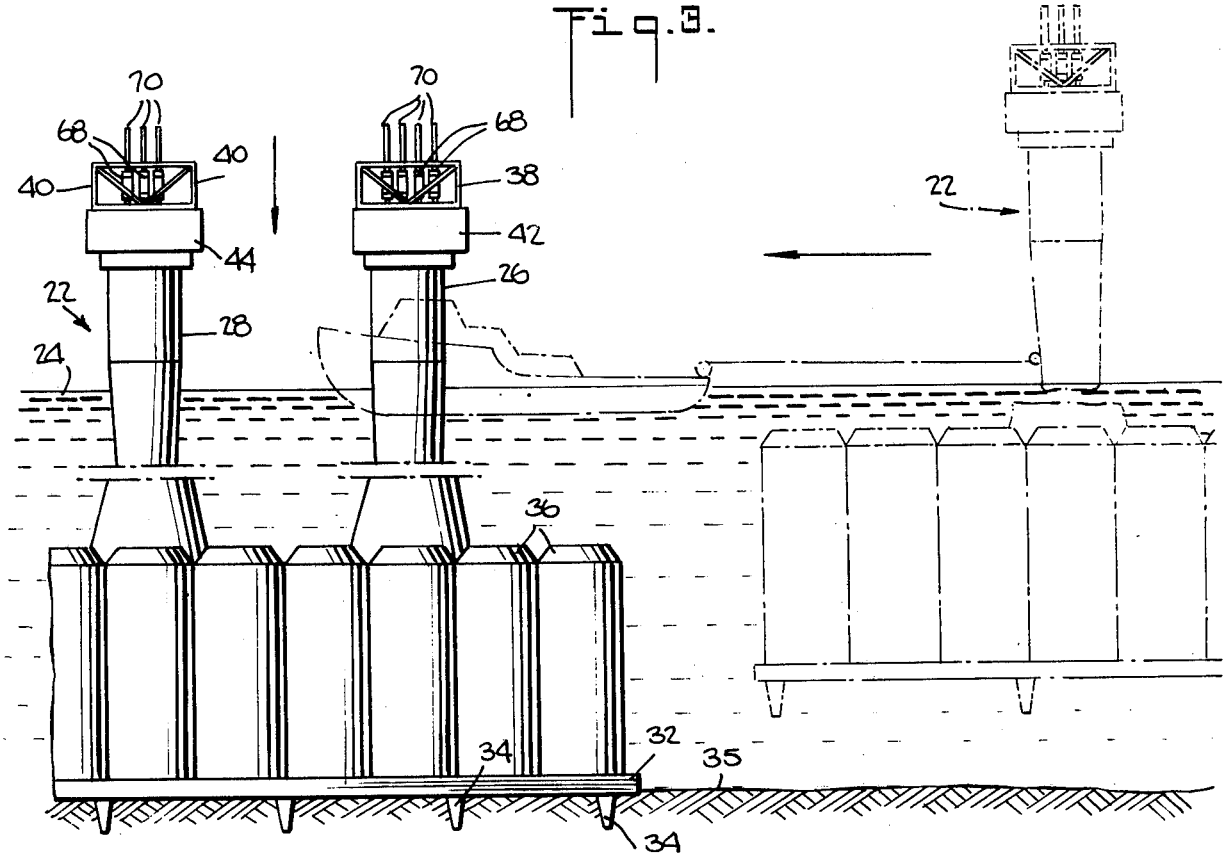
FIG. 3 is a side elevational view showing the placement of a template portion of the offshore tower of FIG. 1 as a first step in the erection of the tower.

It will be noted from FIG. 3 that the pedestals 42 and 44 and the bridge beams 38 and 40 are pre-assembled to the upper ends of the template legs 26 and 28 before the template is towed out to its desired location. Since the bridge beams 38 and 40 are of open framework construction they are relatively light in weight and are of minimum bulk. Therefore they do not offer appreciable resistance to towing nor do they substantially affect balance or buoyancy of the template during the towing operation. In fact, the bridge beams 38 and 40 actually brace the upper ends of the template legs so that it can better withstand the rigors of sea and wind action during the towing operation. On the other hand, if the template 22 were towed with the platform 20 attached, the platform would be subject to wind and/or sea action, which would overstress the structure. Moreover, the structure would not be stable in floating condition and would be likely to capsize.

It will also be noted in FIG. 3 that there are provided within each of the bridge beams 38 and 40, a plurality of jacking mechanisms 68 and associated rigid tubular jacking legs 70. The bridge beams 38 and 40 thus serve as mounting members on the template 22 for the jacking mechanisms 68. This arrangement of jacking mechanisms and jacking tubes permits rapid and convenient interconnection between the template and platform for lifting of the platform to its proper height, as will be explained more fully hereinafter.

Figure 4:
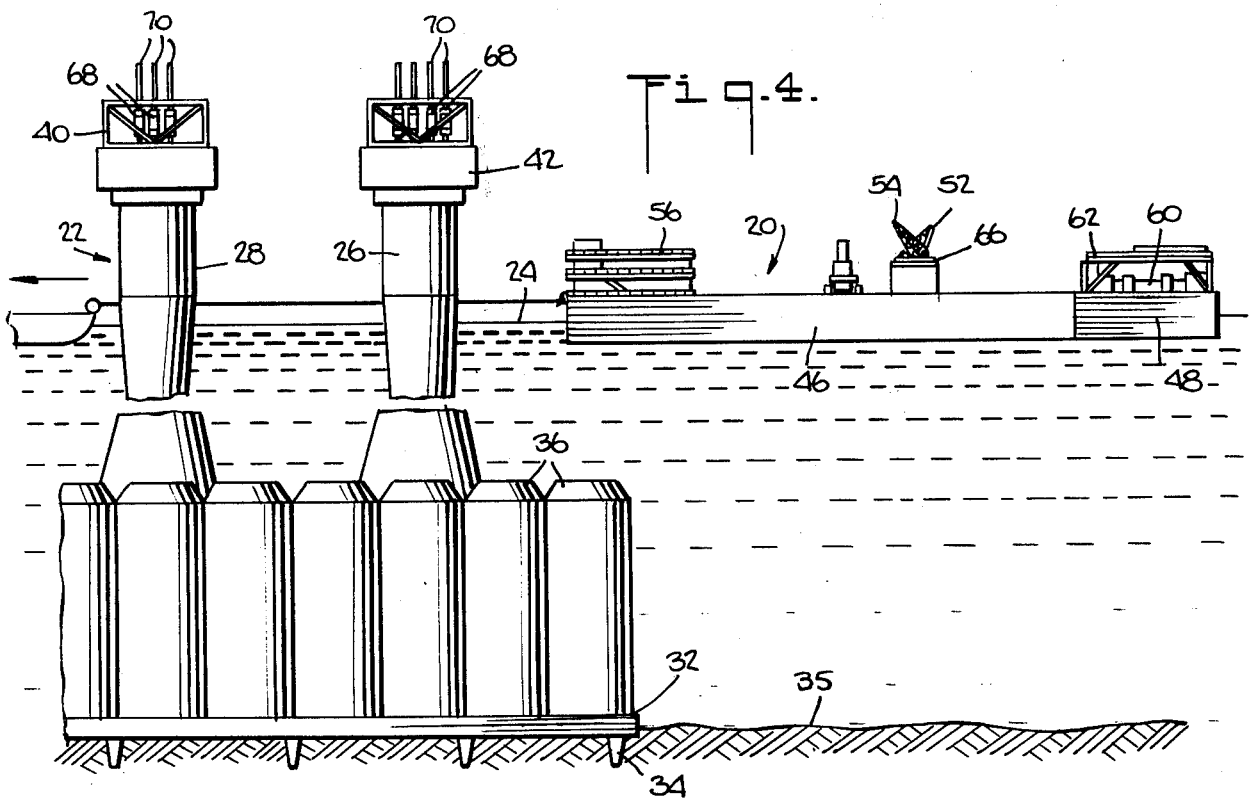
FIG. 4 is a view similar to FIG. 3 but showing the positioning of a platform at the template portion as a second step in the erection of the offshore tower of FIG. 1.
Figure 5:
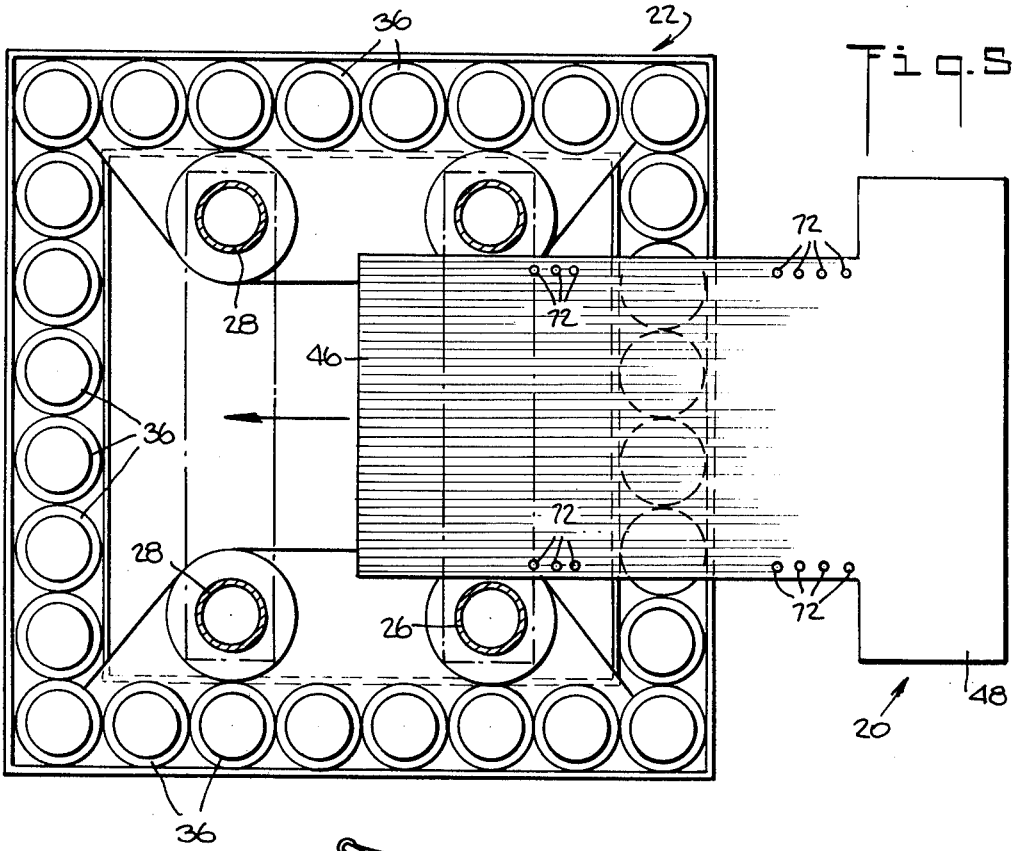
FIG. 5 is a top plan view illustrating the platform and template of FIG. 4.
Figure 6:
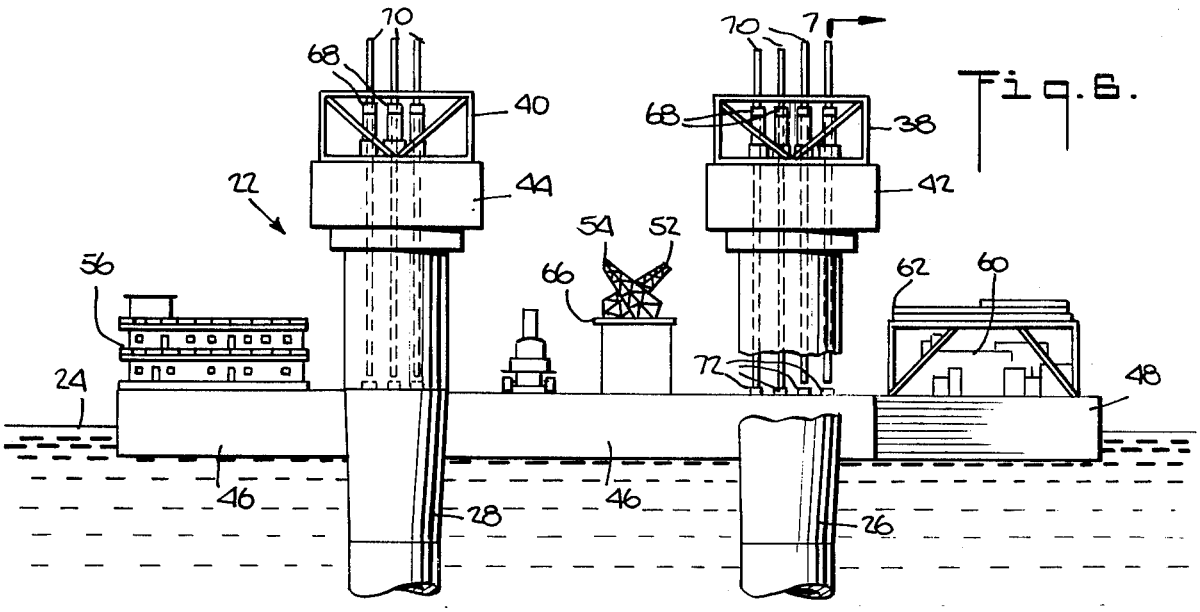
FIG. 6 is a view similar to FIG. 4 but showing the platform fully positioned at the template and ready to be raised thereon.
Figure 7:
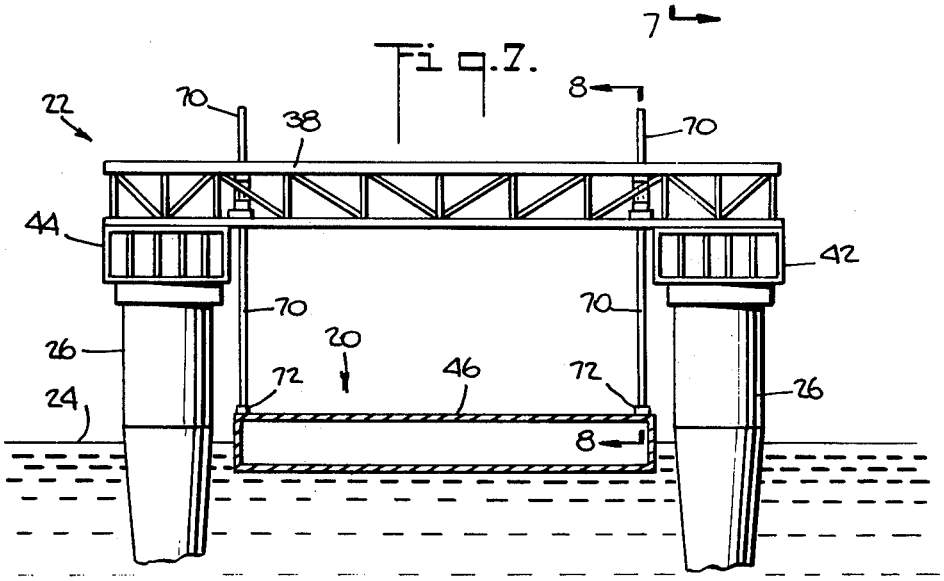
FIG. 7 is a section view taken along line 7—7 of FIG. 6.

After the template 22 has been secured to the sea bed 35, the platform 20 is towed in a floating condition, as shown in FIG. 4, to the template. The platform 20, may be fully constructed at a shore location and there outfitted with the crew quarters 56, the power generating and control equipment 60, the drill pipe storage ledge 62 and the tower and crane positioning ledge 66 with the drilling tower and tower crane 52 and 54 mounted thereon. As shown in FIG. 5, the platform is directed so that its base portion 46 first enters the region between the forward legs 26 and then continues on between and beyond the rearward legs 28 until the platform cross portion 48 nearly abuts the forward legs 26. The platform 20 is provided with jacking leg slips 72 which become aligned with the jacking legs 70 on the bridge beams 38 and 40 when the platform is floated into position. These slips are designed to allow the jacking legs to move freely through then longitudinally in one direction but to grip the legs and prevent relative movement in the opposite direction. As shown in FIG. 6, the jacking mechanism 68 are then operated to lower the jacking legs 70 until they enter their corresponding jacking leg slips 72 on the platform 22 and thereby provide an interconnection between the platform and the bridge beams 38 and 40 extending across the tops of the template legs 26 and 28.

Figure 8:
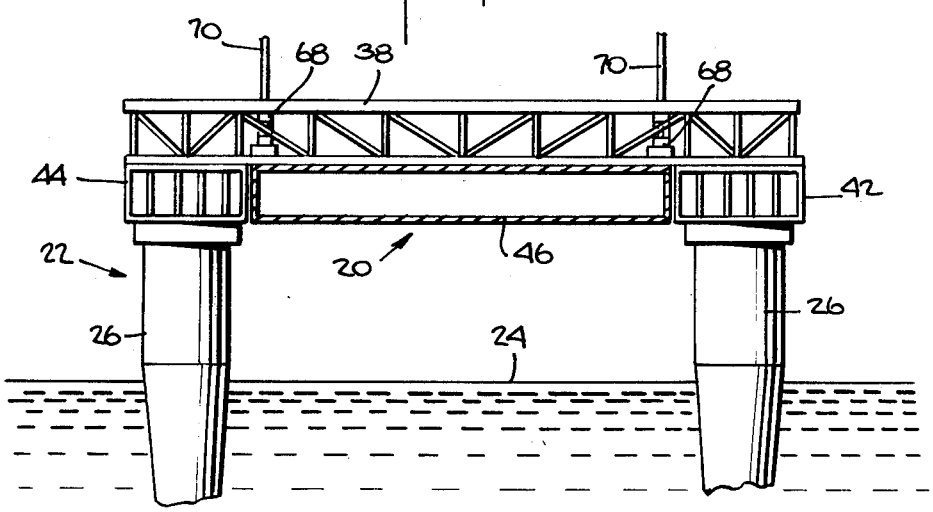
FIG. 8 is an enlarged fragmentary diagramatic view, taken along line 8—8 of FIG. 7.

As can be seen in FIG. 8 the jacking mechanisms 68 each comprise upper and lower holder assemblies 74 and 76 with the lower holder assembly 76 mounted on a portion of one of the bridge beams 38 and 40. Hydraulic piston and cylinder assemblies 78 are driven and controlled by external means (not shown) to move the holder assemblies 74 and 76 toward and away from each other. Slips 80 on the holder assemblies 74 and 76 are controlled to grip and release the jacking leg 70 in alternate sequence as the holder assemblies are moved toward and away from each other respectively. Thus, in order to lower the jacking leg 70 the slip 80 on the lower holder assemblies 76 are released while those on the upper holder assemblies 74 are engaged when the assemblies are moved toward each other and vice versa when they are moved away from each other. In order to raise the jacking leg, the slip engagement and release sequence is reversed. This is shown diagramatically in FIG. 8 by leaf type springs 81 which are held by pins 81*a* and 81*b* to bias either the upper or lower portion of the slips 80 against the jacking leg 70.

When the jacking legs 70 engage the slips 72 on the platform 20 they become secured to the platform in a manner which allows upward but not downward movement of the platform with respect to the jacking legs. That is, the slips 72 allow relative movement of the jacking legs 70 with respect to the slips which coincides with movement of the platform and bridge beam toward each other, but they prevent relative movement in the reverse direction. Thus, should the platform begin to rise as a result of wave or tide action, the slips 72 will alow the platform to move up on the jacking legs. However, the slips 72 act to prevent reverse movement. Thus, wave action is utilized in raising of the platform in a manner similar to that described in U.S. Pat. No. 3,876,181 to Joseph E. Lucas.

After the jacking legs 70 have engaged their respective jacking tube slips in the platform 20 the jacking mechanisms 68 are operated to lift the jacking legs and the platform 20 along with them to raise the platform up to the bridge beams 38 and 40 as shown in FIG. 9. When the platform is fully raised, it is secured to the bridge beams along their length, as by welding. The jacking mechanisms and jacking legs may then be removed for use in the erection of other offshore tower structures. Because of the truss-like open framework configuration of the bridge beams 38 and 40 they provide a skeletal type support which strengthens and rigifies the platform when it has been raised and secured to the bridge beams. Also, since the bridge beams span the distance between template legs the platform may be of much lighter and less rigid construction than would have been necessary if the platform had to span the template legs on its own.

Figure 10:
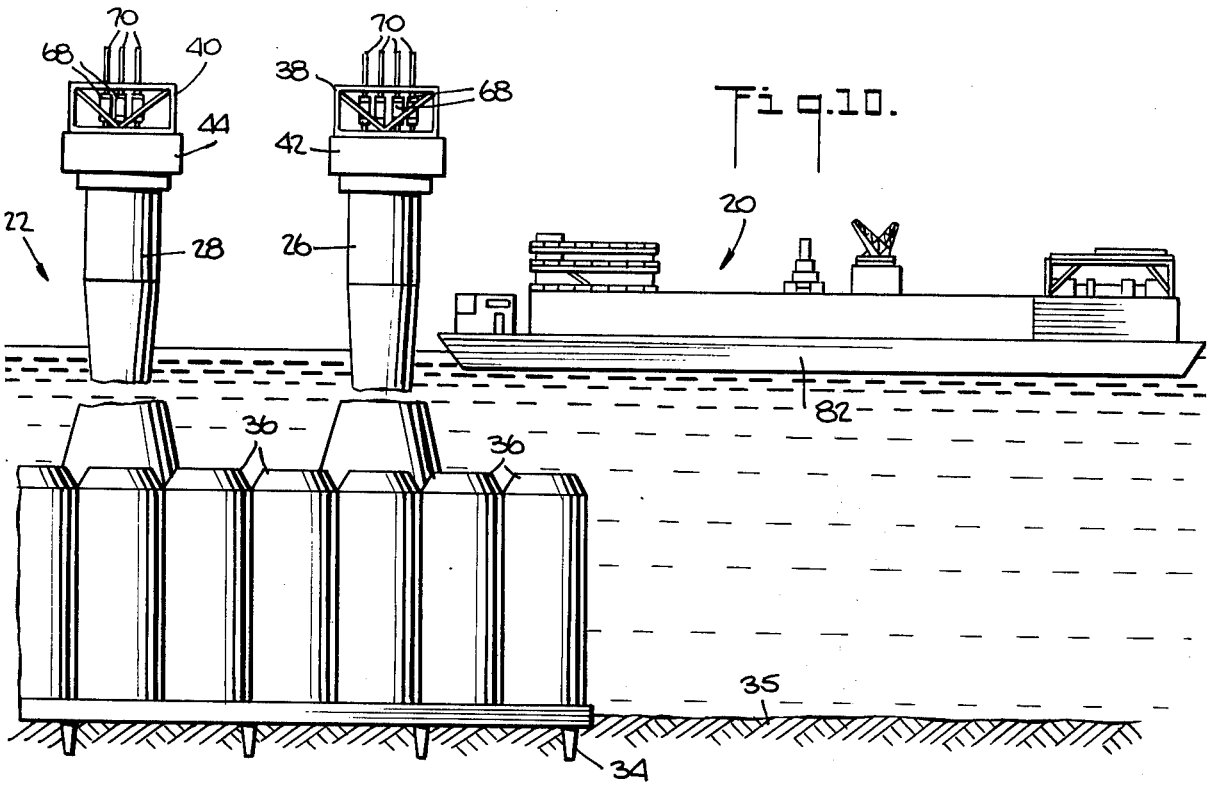
FIG. 10 is a view similar to FIG. 4 but showing the positioning of a barge mounted platform positioned at the template.
Figure 11:
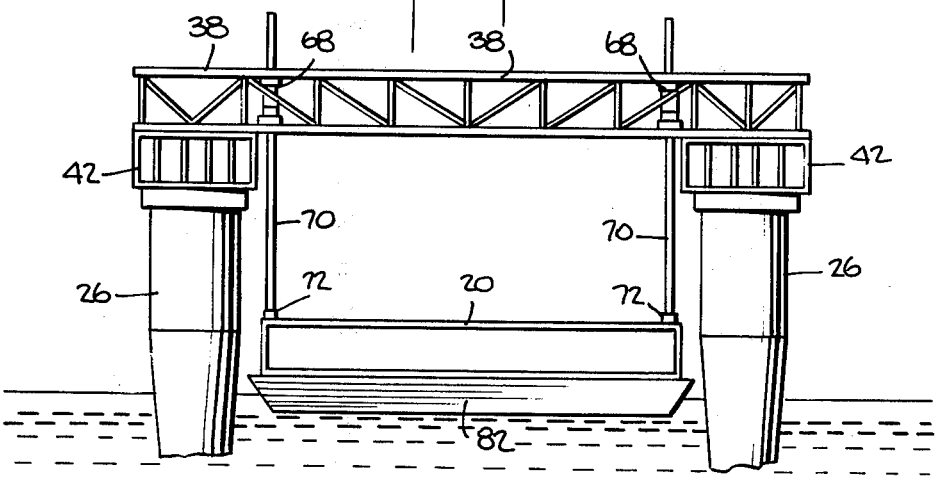
FIG. 11 is a view similar to FIG. 7 but showing a barge mounted platform.
Figure 12:
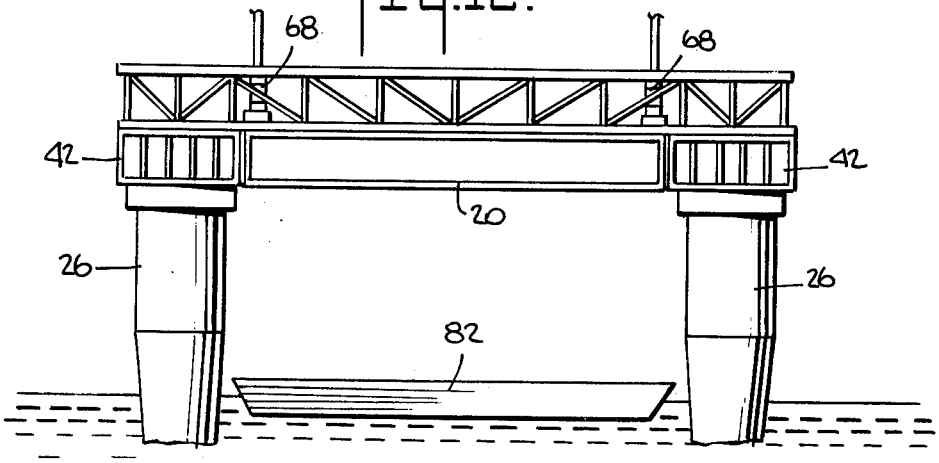
FIG. 12 is a view similar to FIG. 11 but showing a raised barge mounted platform.

FIGS. 10–12 show a modified arrangement wherein the platform 20 is carried out on a barge 82 to the template 22. This arrangement permits the platform to be designed without regard to buoyancy or ability to withstand the stresses of sea action. As shown in FIG. 11 the jacking legs 70 are engaged in the jacking tube slips 72 on the platform while it is supported by the barge 82; and as shown in FIG. 12 the jacking mechanisms 68 operate to lift the platform up off the barge to the bridge beams 38 and 40 for subsequent attachment thereto. The jacking mechanisms and jacking legs 68 and 70 may then be disconnected and lowered back down to the barge for use in the erection of another offshore tower structure.

Figure 13:
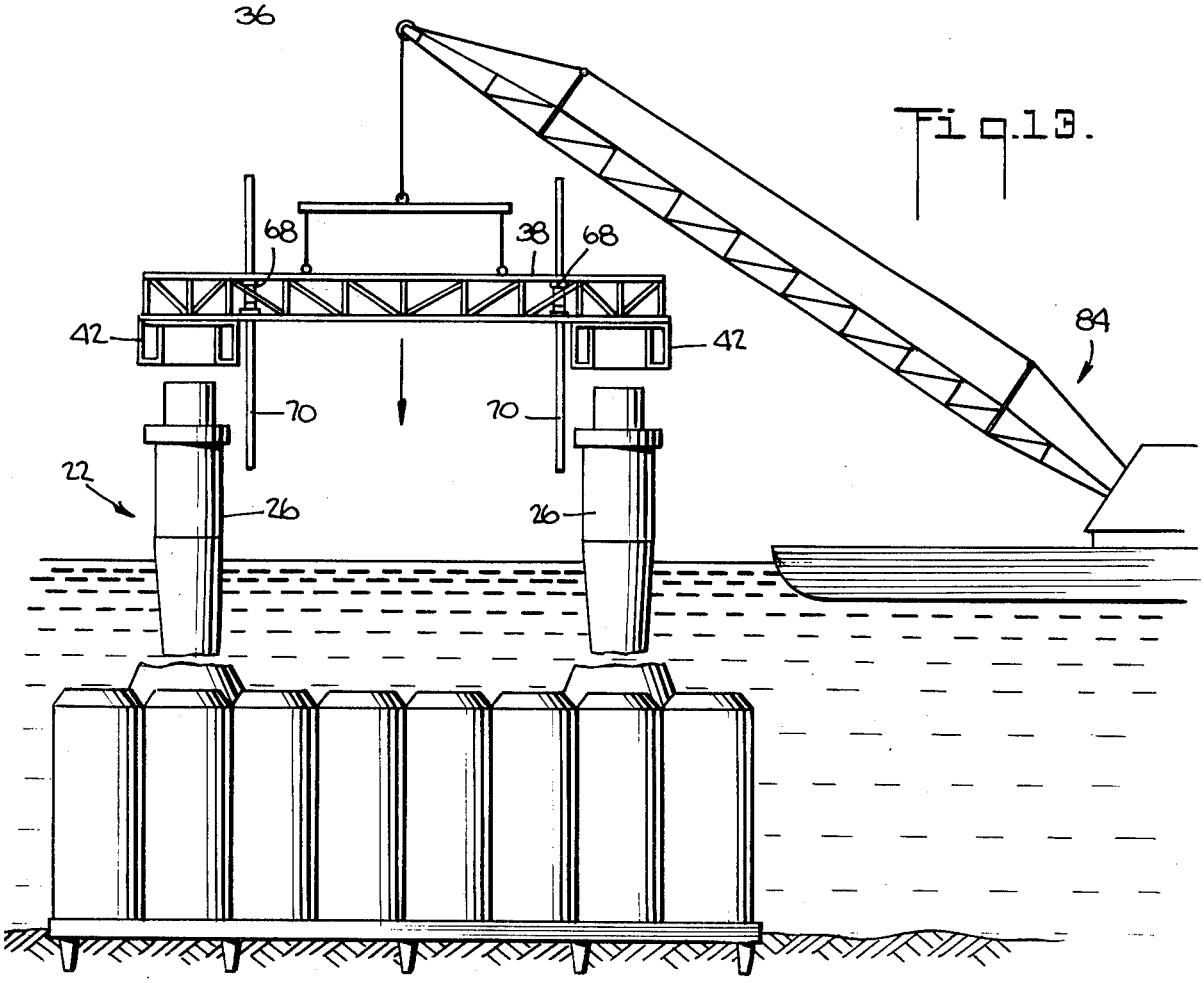
FIG. 13 illustrates a modified arrangement whereby a bridge beam is mounted atop a previously installed template.

FIG. 13 shows another modification wherein the template 22 is floated to location and installed there prior to installation of the bridge beams 38 and 40. These beams may then be installed by means of a derrick barge 84. As shown, the jacking mechanisms and jacking legs 68 and 70 may be previously mounted on the bridge beams so that the entire bridge beam and jacking assembly may be positioned on top of the template legs 26 and 28. Because the bridge beams are of open framework construction they may be handled by a derrick barge rather easily, as compared to the platform itself.

Figure 14:
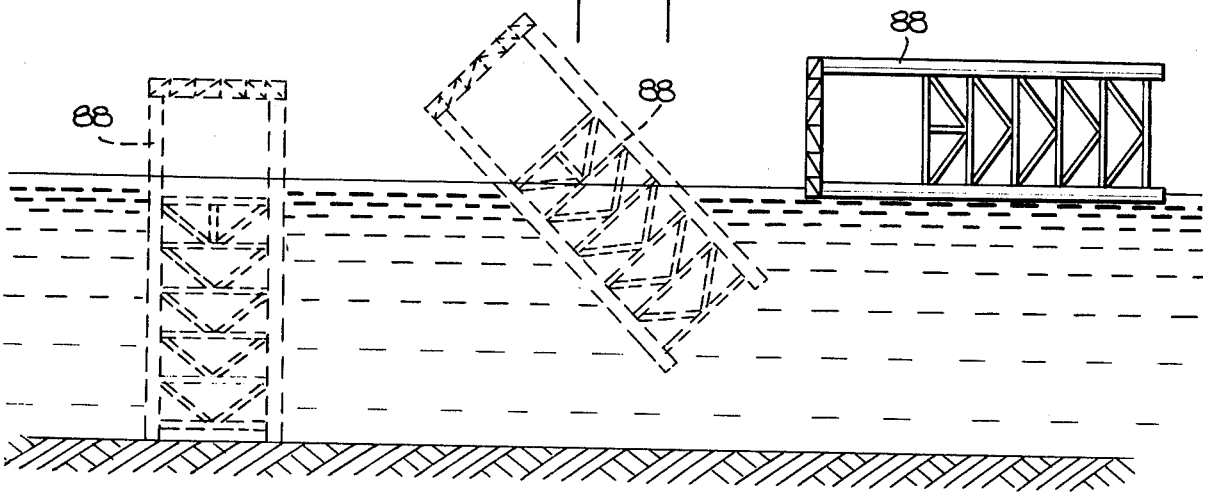
FIG. 14 illustrates a modified arrangement wherein a tilt-up type template is installed.
Figure 8:
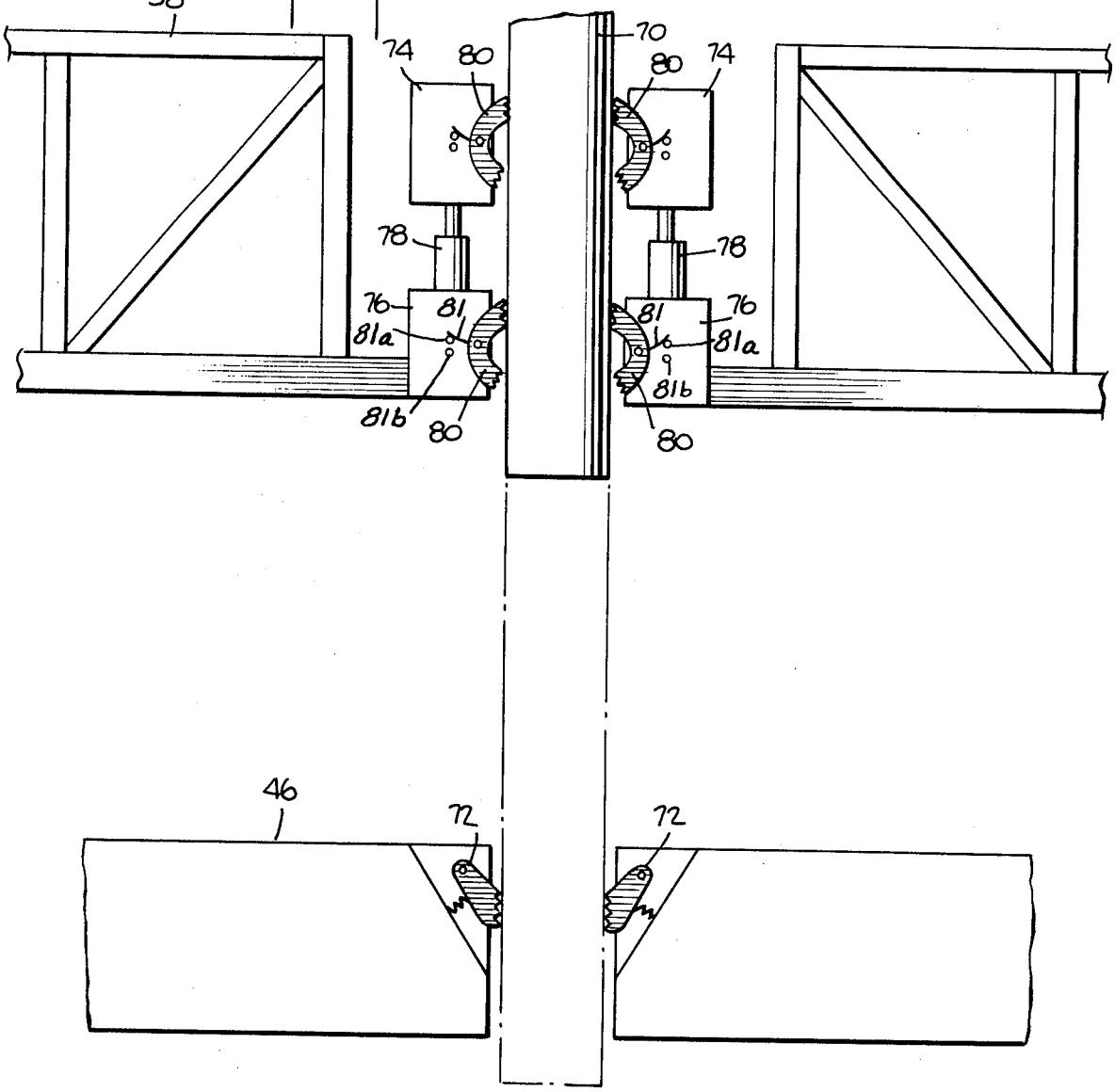

FIG. 14 shows the installation of a tilt-up type template 86 with preassembled bridge beams 88. The basic idea of horizontally floatable template which is tilted to upright position by selective flooding is well known and is shown for example, in U.S. Pat. No. 2,857,744 to W. F. Swiger, et al. In that patent a temporary truss 22 is shown attached to the upper ends of the template legs; however, it is believed that the present invention represents the first time that bridge beams have been used in the lifting and reinforcing of a platform structure.

Having thus described the invention with particular reference to the preferred forms thereof, it will be obvious to those skilled in the art to which the invention pertains, after understanding the invention, that various changes and modifications may be made therein without departing from the spirit and scope of the invention as defined by the claims appended hereto.

What is claimed and desired to be secured by Letters Patent is:

1. A method of erecting an offshore tower, said method comprising the steps of positioning a template, having a plurality of spaced apart vertical legs, on a sea floor so that said vertical legs extend up above the sea level, said template being provided with at least one open framework bridge beam connected to and extending between the upper ends of said vertical legs, floating a platform out to the thus positioned template and locating the platform so that it is adjacent the template legs and is under and in alignment with said bridge beam, thereafter interconnecting jacking units, comprising jacking leg means and jacking mechanism means and operative to undergo longitudinal movement with respect to said jacking leg means, between said bridge beam and the thus located platform so that one of said means is connected to said bridge beam and the other of said means is connected to said platform and operating said jacking mechanisms means to raise said platform clear of the water.

2. A method of erecting an offshore tower according to claim 1 wherein said jacking units are interconnected by securing said jacking mechanism means to said bridge beam and by connecting said jacking leg means to said platform.

3. A method of erecting an offshore tower according to claim 1 wherein said platform is raised by said jacking units up to said bridge beam and is then fastened to said bridge beams along its length.

4. A method of erecting an offshore tower according to claim 1 wherein said jacking leg means is moved by said jacking mechanism means to enter into and to be engaged by slips in said platform which allow movement of the jacking leg means therethrough in a direction which corresponds with raising of the platform but not in the reverse direction.

5. A method of erecting an offshore tower according to claim 1 wherein said bridge beam is connected to said template legs after said template is anchored to the sea floor and before said platform is raised.

6. A method of erecting an offshore tower according to claim 1 wherein said platform is secured to said bridge beam after it has been raised.

7. A method of erecting an offshore tower according to claim 6 wherein said jacking units are disconnected and removed from said platform and bridge beam after said platform has been secured to said bridge beam.

8. A method of erecting an offshore tower, said method comprising the steps of positioning on a sea floor, a template having at least one vertical template leg with a mounting member thereon, so that said template leg with said mounting member extends up above the sea level, floating a platform member out to the thus positioned template, at least one jacking mechanism being secured to one of said members and operative to move an elongated rigid jacking leg in a vertical direction, operating said jacking mechanism to move said jacking leg longitudinally in one direction through a slip mechanism in the other member, said slip mechanism being constructed to allow free movement of said jacking leg in a direction which coincides with movement of said members toward each other and to prevent relative movement in the reverse direction, and thereafter operating said jacking mechanism to move said jacking leg in said opposite direction to elevate said platform member clear of the water.

9. A method of erecting an offshore tower according to claim 8 wherein said jacking mechanism is secured to said mounting member and wherein said slip mechanism is provided in the platform member.

10. A method of erecting an offshore tower according to claim 8 wherein said platform member is secured to said template after it has been raised and wherein said jacking mechanism and jacking leg are thereafter disconnected and removed from said members.

11. A method of erecting an offshore tower, said method comprising the steps of positioning a template, having a plurality of spaced apart vertical legs, on a sea floor so that said vertical legs extend up above the sea level, said template being provided with at least one open framework bridge beam connected to and extending between the upper ends of said vertical legs, positioning a platform adjacent to the thus positioned template, raising said platform clear of the water, to said bridge beam and thereafter securing said platform to said bridge beam whereby it becomes stiffened and reinforced by said beam.

12. A method of erecting an offshore tower according to claim 11 wherein said platform is raised by interconnecting jacking units between said platform and said bridge beam.

13. A method of erecting an offshore tower according to claim 11 wherein said platform is secured to said bridge beam along its length.

14. A method of erecting an offshore tower according to claim 11 wherein said jacking units are disconnected and removed from said platform and bridge beam following securing of said platform to said bridge beam.

15. A method of erecting an offshore tower according to claim 11 wherein the platform is floated out to the template.

16. An offshore tower construction comprising a template constructed to be anchored to a sea floor, said template including a pair of forward spaced apart vertical template legs and a pair of rearward spaced apart vertical template legs which extend up above the surface of the sea when said template is secured to the sea floor, forward and rearward open framework bridge beam members extending across the space between and interconnecting the legs of the forward and rearward pairs of said template legs, respectively, near their upper end above the sea surface, a platform member constructed to be positioned adjacent said template legs, jacking mechanisms mounted on one of said members and elongated jacking legs extending from said jacking mechanisms to the other member and connected thereto, whereby operation of said jacking mechanisms will pull up on said jacking legs and raise said platform clear of the water.

17. An offshore tower construction according to claim 16 wherein said jacking mechanism is mounted on said bridge beam members.

18. An offshore tower construction according to claim 16 wherein a plurality of jacking mechanism with associated jacking legs are arranged alongside each of the template legs to extend between said bridge beam members and said platform member.

19. An offshore tower construction according to claim 16 wherein said bridge beam member is constructed to support a drilling tower and to accommodate movement of said drilling tower to different drilling locations along the span of said bridge beam member.

20. An offshore tower construction comprising a template constructed to be anchored to a sea floor, said template including a plurality of spaced apart vertical template legs which extend up above the surface of the sea when said template is secured to the sea floor, an open framework bridge beam member extending across and interconnecting at least two of said said template legs near their upper end above the sea surface, a platform member constructed to be positioned adjacent said template legs, jacking mechanisms mounted on said bridge beam member and elongated jacking legs extending from said jacking mechanisms to said platform member and connected thereto, whereby operation of said jacking mechanisms will pull up on said jacking legs and raise said platform clear of the water, said platform being provided with slips which accommodate said jacking legs and which allow relative movement with respect to said jacking legs in a direction which corresponds to raising of said platform member but which prevent relative movement in the reverse direction.

21. An offshore tower construction comprising a template constructed to be anchored to a sea floor, said template including a plurality of spaced apart vertical template legs which extend out above the surface of the sea when said template is secured to the sea floor, an open framework bridge beam structure extending across and interconnecting at least two of said template legs near their upper end above the sea surface, an expansive platform supported above the sea surface by said template and secured thereto along the length of said bridge beam structure whereby said platform is stiffened and reinforced by said bridge beam structure, said bridge beam structure being constructed to support oil well drilling machinery and to accommodate movement of said machinery to different drilling locations along said bridge beam structure, said platform further being formed with a ledge which accomodates said oil well drilling machinery, said ledge being located adjacent said bridge beam structure.

22. An offshore tower construction according to claim 21 wherein said template includes forward and rearward pairs of legs and forward and rearward bridge beam structures connected to and spanning the distance between the legs of the forward and rearward pairs respectively, said platform extending between and along each of said bridge beam structures and secured thereto along their respective lengths.

23. An offshore tower construction according to claim 21 wherein said platform extends laterally beyond said bridge beam structure.

24. An offshore tower construction comprising a template constructed to be anchored to a sea floor, said template including at least one vertical template leg which extends out above the surface of the sea when said template is secured to the sea floor, a mounting member connected to the upper end of at least said one template leg, a platform member constructed to be positioned adjacent said template leg and to be lifted upwardly therealong clear of the water, at least one jacking unit comprising an elongated rigid jacking leg and a jacking mechanism operative to produce relative longitudinal movement with respect to said jacking leg, said jacking unit being mounted to extend vertically between said platform member and said mounting member with said jacking mechanism mounted on one of said members and slip means on the other member for receiving said jacking leg, said slip being constructed to allow relative movement of said jacking leg in a direction which coincides with movement of said members toward each other and to prevent relative movement in the reverse direction.

25. An offshore tower construction according to claim 24 wherein said jacking mechanism is on said mounting member and wherein said slip means is on said platform member.

26. An offshore tower construction according to claim 24 wherein said template is formed with a plurality of spaced apart vertical template legs and open framework bridge beams spanning the distances between different pairs of said template legs near the upper ends thereof.

27. An offshore tower construction according to claim 24 wherein a plurality of jacking mechanisms are mounted on said bridge beams near said template legs, each of said jacking mechanisms having an associated jacking leg extending therethrough and said platform being provided with plural slip means which become aligned with said jacking legs.

* * * * *